US006315481B1

(12) United States Patent
Gavorski et al.

(10) Patent No.: US 6,315,481 B1
(45) Date of Patent: Nov. 13, 2001

(54) SELF-CONTAINED CLEANING SYSTEM INCLUDING INTEGRAL BOTTLE

(75) Inventors: Micheal J. Gavorski; Tammy Westerman, both of Cleveland; Nicholas Stanca, Westlake, all of OH (US)

(73) Assignee: State Industrial Products, Cleveland, OH (US)

( * ) Notice: Subject to any disclaimer, the term of this patent is extended or adjusted under 35 U.S.C. 154(b) by 0 days.

(21) Appl. No.: 08/684,098

(22) Filed: Jul. 22, 1996

(51) Int. Cl.[7] ..... B47K 5/18

(52) U.S. Cl. ..... 401/150; 401/290; 401/283; 401/284; 401/272; 401/138; 401/140

(58) Field of Search ..... 401/146, 149, 401/150, 290, 283, 284, 272, 273, 138, 140, 278, 36; 141/375, 354, 349, 335; 222/378, 325

(56) References Cited

U.S. PATENT DOCUMENTS

| | | | | |
|---|---|---|---|---|
| 180,985 | * | 8/1876 | Birtwistle | 401/284 |
| 947,917 | * | 2/1910 | Kollenberg | 141/351 X |
| 1,044,395 | * | 11/1912 | Kenady | 401/278 |
| 1,138,772 | * | 5/1915 | Matthews | 401/273 |
| 1,230,072 | * | 6/1917 | Johnson | 401/284 |
| 1,336,604 | * | 4/1920 | Baker | 401/284 |
| 1,753,514 | * | 4/1930 | Hardie | 401/273 |
| 2,373,050 | * | 4/1945 | Penick | 401/283 X |
| 2,575,124 | * | 11/1951 | Pollitt | 401/138 X |
| 2,989,091 | * | 6/1961 | Lowenthal | 141/354 X |
| 3,551,935 | * | 1/1971 | Gaudry et al. | 401/290 X |
| 4,534,669 | * | 8/1985 | Heck et al. | 401/146 X |
| 4,608,045 | * | 8/1986 | Fretwell | 401/146 X |
| 4,618,279 | * | 10/1986 | Gurevich et al. | 401/36 |
| 4,983,061 | * | 1/1991 | Demarest | 401/148 |

FOREIGN PATENT DOCUMENTS

| | | | | |
|---|---|---|---|---|
| 659729 | * | 2/1964 | (IT) | 401/138 |

* cited by examiner

*Primary Examiner*—David J. Walczak
(74) *Attorney, Agent, or Firm*—Lightbody & Lucas

(57) ABSTRACT

A cleaning system utilized a bottle having an integrally formed handle in conjunction with connection section, including a pump, leading to an integral brush to provide for an integral single piece cleaning system wherein the handle for the bottle serves as the handle for the cleaning system and, in conjunction with the connection section, as a pump for the fluid in the bottle.

34 Claims, 4 Drawing Sheets

SELF-CONTAINED CLEANING SYSTEM INCLUDING INTEGRAL BOTTLE

FIELD OF THE INVENTION

This invention relates to a cleaning system for use in industrial and consumer applications for cleaning rest rooms, kitchens, windows, and other items typically cleaned by a combination of a liquid and some sort of hand tool.

BACKGROUND OF THE INVENTION

Cleaning systems are a bane of modern life. Typically these cleaning systems comprise a large bottle containing a cleaning solution, a measuring cup or sprayer, and then a separate hand tool such as the ubiquitous bathroom brush. These systems are functional to a sufficient extent such that they have stood the test of time. However, the systems are also relatively inefficient in both the utilization of the cleaning personnel as well as the waste of the cleaning chemicals (occasioned in part by the somewhat imprecise dispensing systems). This is especially so since the amount of chemical utilized per application may differ from individual to individual as well as between applications for a single individual. An example of this latter would be the understandable difference in measuring from a full one gallon bottle to an almost empty one gallon bottle.

OBJECTS OF THE INVENTION

It is an object of the present invention to provide for a self contained cleaning system.

It is another object of the present invention to simplify cleaning operations.

It is yet another object of the present invention to integrate the components of a cleaning system, thus providing for more reliable consistent cleaning function.

It is still another object of the present invention to increase the adaptability of cleaning system components.

It is a further object of the present invention to increase the longevity of cleaning systems.

It is yet a further object of the present invention to reduce undue stress on an operator.

Other objects and a more complete understanding of the invention may be had by referring to the following description and drawings in which:

BRIEF DESCRIPTION OF THE DRAWINGS

The structure, operation, and advantages of the presently disclosed preferred embodiment of the invention will become apparent upon consideration of the following description taken in conjunction with the accompanying drawings wherein.

DETAILED DESCRIPTION OF THE INVENTION

Figure 1:
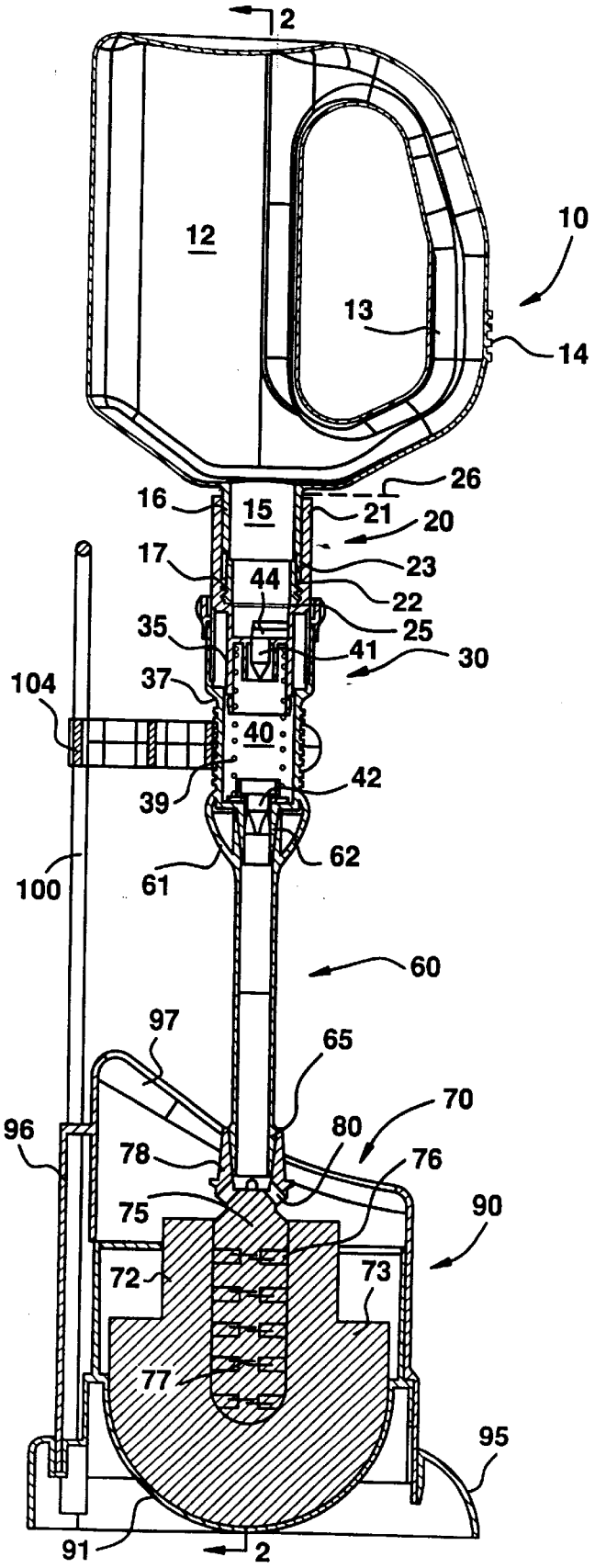
FIG. 1 is a longitudinal cross section of cleaning system incorporating the invention of the application.
Figure 2:
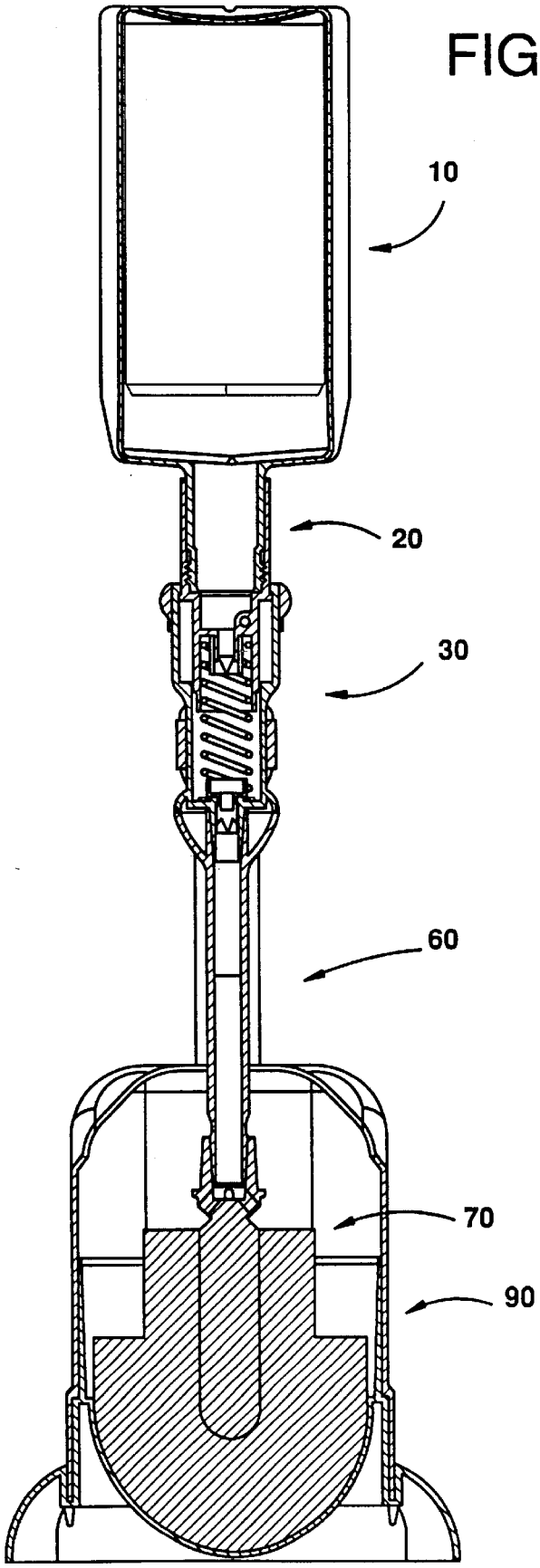
FIG. 2 is a further longitudinal cross section of the cleaning system of FIG. 1 taken substantially along lines 2—2 of such figure.
Figure 3:
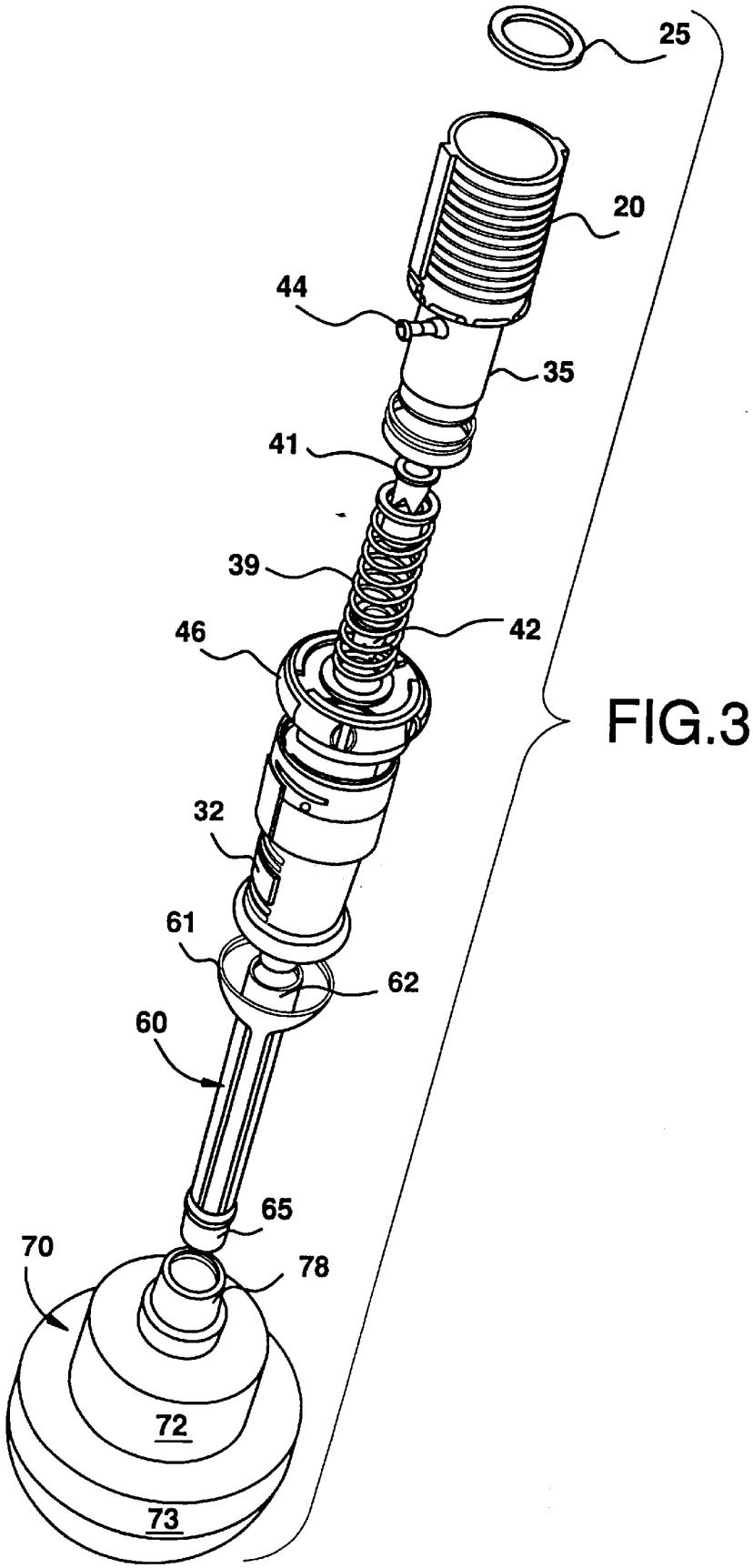
FIG. 3 is a perspective view of the main operating parts of the cleaning system of FIG. 1; and, FIGS. 4 and 5 are two side views of the cleaning system of FIG. 1.
Figure 4:
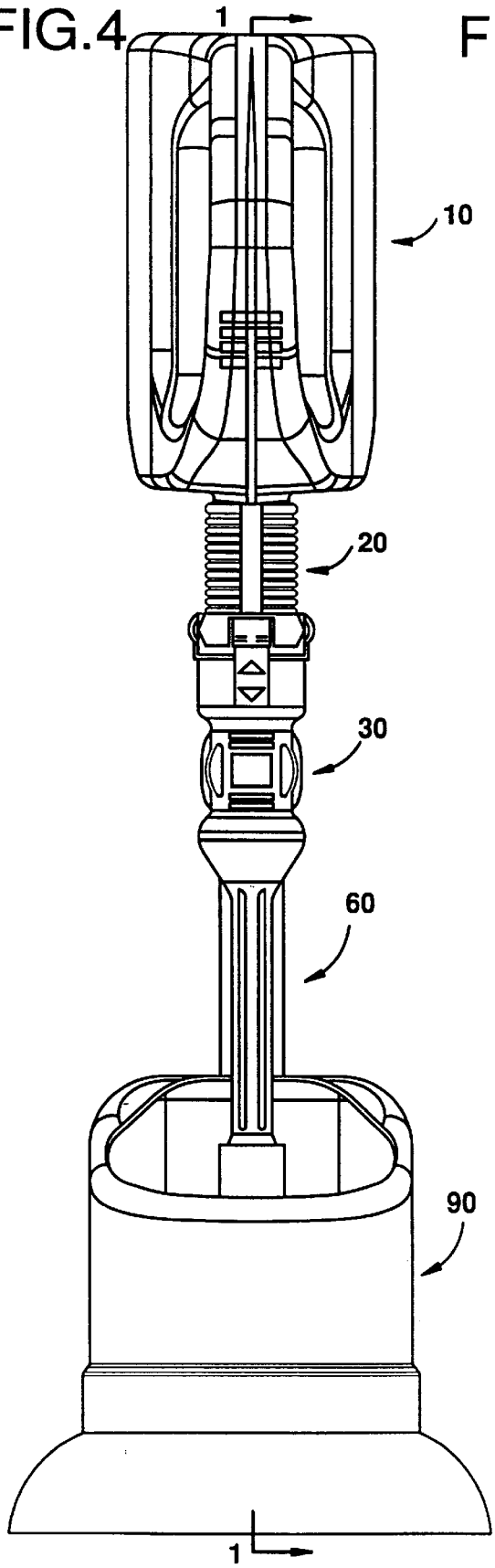
Figure 5:
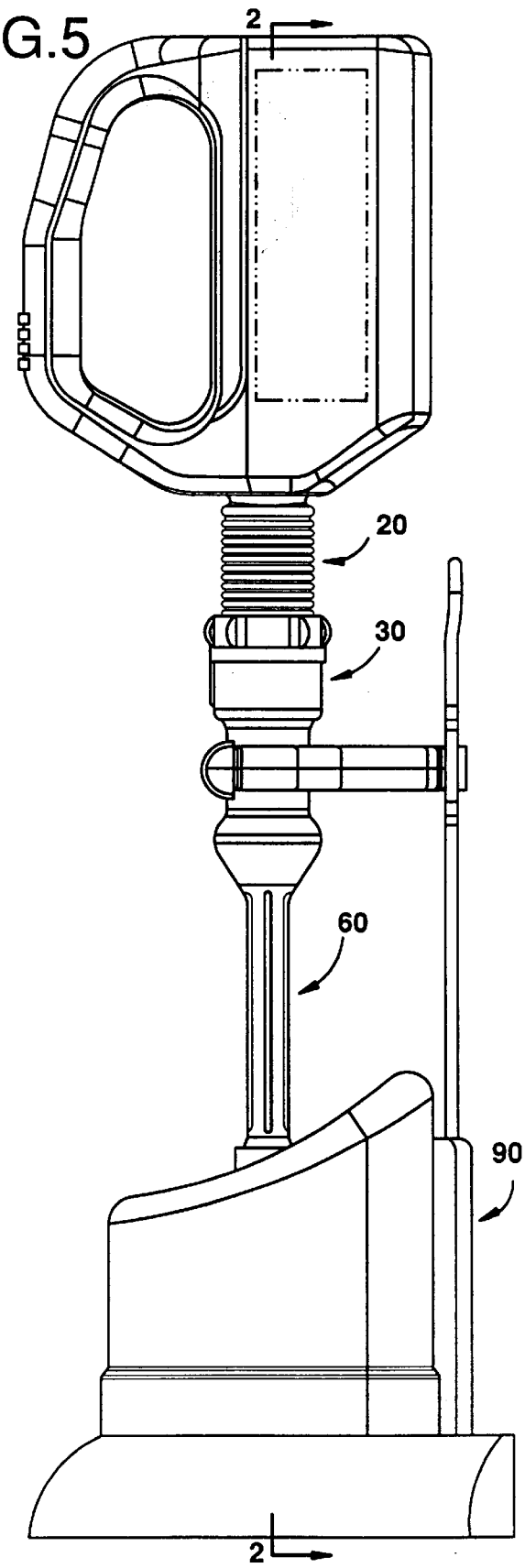

The cleaning system of this invention includes a bottle section 10, a connection section 20, a pump section 30, an extended section 60, a brush section 70, and a caddy stand section 90.

The bottle section 10 is designed to contain the refills for the cleaning system as well as serving as the primary handle thereof. The bottle section 10 can be or include a substantially rectangular, cylindrical, round or other shape as desired. It can include a separate handle, a self handle (i.e. small diameter bottle), or an integral handle (i.e. a molded in reduced dimension holding section).

The particular preferred bottle section 10 disclosed includes a primary reservoir 12, a handgrip 13, and a neck 15.

The preferred primary reservoir 12 shown is a substantially rectangular shaped reservoir serving as the primary location for the storage and, as later described, the distribution of the particular cleaning substance. This cleaning substance can range through a whole range of relatively aqueous substances, from a light cleaning substance such as a consumer glass cleaner through stronger substances such as those based on phosphoric acid and hydrogen chloride The particular reservoir 12 disclosed is approximately 6.5 inches high, 3.5 inches deep, and 3.5 inches long.

The textured handgrip 13 serves as the overall grip for the entire cleaning system. In addition, because the textured handgrip 13 is hollow, it serves as a secondary reservoir for the bottle section 10. Small laterally extending knurls 14 on the handgrip provide tactile feedback that the operator's hand in the proper position. Note that due to the bottle's symmetry, the handgrip is suitable for use by either a right or left handed person. Other means of holding the system could also be utilized.

The neck 15 of the bottle section 10 serves to solidly interconnect the bottle section 10 to the later described pump section 30. This combines these units into an integral whole.

The particular preferred neck 15 disclosed has an extended neck section 16 and a thread section with threads 17. These components cooperate with the later described connection section 20 to join the bottle section 10 with the pump section 30. It is preferred that the extended neck section 16 extend for a significant distance from the bottle 10 prior to joining with the threads 17. The reason for this is that the longitudinal extent of the neck helps to angularly lock the bottle section 10 to the connection section 20. Further, this construction allows a standard screw thread to be utilized to actually physically join the bottle section 10 to the pump section 30. This allows a manufacturer to utilize a common source of caps and other standard screw thread adapters (it also allows this extended neck bottle to be utilized with standard thread fixtures). Further, since the preferred extended neck section 16 does not have any threads, it provides for a solid bearing surface between the bottle 10 and connection section 20. Note that if desired the threads 17 could extend longer, up to and including the full length of the neck 15. Under these circumstances the outer diameter of such threads 17 would at least partially angularly interconnect the neck 15 to the connection section 20. Alternately a less than full length collar off of the base of the neck 15 at its junction with the bottle (or spaced collars) could replace the full diameter extended neck section 16. These variations are within the claimed invention.

The particular neck 15 disclosed is approximately 1.8 inches long and 28 millimeters outside diameter with a threaded section using standard threads and extending substantially 0.5 inches off of the end of the extended neck 16. The extended neck section 16 is itself substantially 1.2 inches long.

The connection section 20 of the system cooperates with the neck 15 of the bottle section 10 in order to solidly interconnect the bottle 10 with the remainder of the device. Due to the use of the bottle section 10 being the primary handle for the device (preferably via the handgrip 13), it is important that this area be strong and capable of withstanding angular and sideward loads so as to provide for a convenient, efficient, long-lived cleaning system.

The particular connection section 20 disclosed is formed integral with the pump section 30 as a long tubular section 21 culminating in a female threaded section 22.

The dimensions and sizing of these components of the connection section 20 are chosen to match the corresponding elements of the neck 15 of the bottle section 10 thus ensuring a reliable interconnection at this point. Preferably only the female thread section 22 matches the threads 17 of the neck 15 and the tubular section 21 matches the extended neck section 16 of the neck 15. (Note that the male/female threads could be reversed if desired). Further preferably a slight gap 23 separates the tubular section 21 from the female threads 22 of the connection section 20. This slight gap 23 insures that the extended neck section 16 of the bottle does not bottom on the female screw threads 22 before the end of the neck 15 has solidly interengaged the leakproof gasket 25 that is located between the end of the neck 15 and the connection section 20.

The particular preferred connection section 20 disclosed is approximately 1.8 inches long with a 28 millimeter inside diameter using threads matching those of the neck 15. The long tubular section 21 is itself substantially 1.2 inches long.

The gasket 25 serves two purposes. The first purpose is to prevent leaks between the neck 15 and connection section 20; these leaks including both ingress and egress. The second purpose of the gasket 25 is to resist any unscrewing of the neck 15 from the connection section 20 so as to allow the operator to place a rotary or radial component on the handle of the device without fear of separation of components. In this respect, it is noted that the dimensions and relationships of the neck 15, the gasket 25 and connection section 20 are selected such that the handgrip 13 of the preferred bottle 10 will substantially line up with the pictorial directions on the pumping mechanism as well as the later described pump lock. This adds an instinctive control to this interconnection. If desired, a separate lock (representational form 26 in FIG. 1) could be incorporated to further strengthen this interconnection against rotary motion.

A pump section 30 serves to transfer the aqueous material from the bottle section 10 to the brush section 70.

The particular pump section 30 disclosed is a piston pump requiring a reactionary force in order to operate the pump. The reactionary force is accomplished in the preferred embodiment disclosed by the operator manually grasping the main immovable body of the pump section (normally the hand hold 13 defined by knurls 14) and by placing the end of the later described brush section against a solid member or physically moving one of the bottle section 10 and/or the brush section towards the other so as to manipulate the pump. Knurls 32 aid in locating the secondary pump handle.

The particular pump 30 operates by having a piston 35 integral with the connection section 20 and the neck 15 of the bottle 10 for movement in conjunction thereto. As the piston 35 is longitudinally moved in respect to the body section 37 of the pump, a valve system 40 operates, This valve system 40 consists of two one-way valves 41, 42 in combination with a relief valve 44.

The valve 41 is a one-way valve located at the end of the pump section 30 sealedly connected to the body section 37. This one-way valve 41 allows fluid to be pushed through the valve from the bottle section to the brush section. This valve 41 operates on the downward motion of the piston 35 in respect to the body section 37. The valve 41 closes upon any attempt of return movement.

The particular preferred one-way valve 41 and the second one-way valve 42 are identical cross-slit check valves. The particular pump is designed to pump ½ oz for one(1) pump with 1 oz for two(2) pumps.

Upon completion of the pumping cycle, the piston 35 is returned to its initial position in respect to the body section by the operator. A return spring 39 aids this movement. During the return movement, the other one-way valve 42 (located adjoining the neck 15) opens to allow fluid to be vacuumed from the bottle into the body section 37 of the pump through such valve 42. A relief valve 44 is associated with the bottle 10. The relief valve 44 allows the unhindered return of the bottle 10 to its normal position. The particular preferred relief valve 44 is a duck bill valve. In this manner, a precise metered amount of the aqueous fluid in the bottle 10 can be applied to the brush section 70, each and every pumping action providing a specific known quantity of fluid thereto. In the preferred embodiment disclosed, typically two pumps is sufficient for light cleaning while four pumps might be utilized for more difficult jobs. This again allows a precisely metered amount of the fluid to be dispensed to the brush section reliably and repeatedly. This allows the cleaning action to be more consistent between operators as well as for an individual operator irrespective of the amount of fluid which might happen to be in the bottle 10. Partial pumps could also be used.

Preferably a pump lock 46 located between the body section 37 and the connection section 20 locks the tubular section 21 into fixed position in respect to the remainder of the pump section 30. When this pump lock 46 is in this position, it is impossible to manipulate the pump, thus allowing an increase of force to be applied to the brush section without possible manipulation of the pump. A rotatable pump lock is shown. Other locking systems could alternately be utilized.

The extended stem section 60 interconnects the pump section 30 with the later described brush section 70 so as to provide for a measure of separation between the operator and the brush. Further, this allows the operator to utilize the particular properties of the preferred brush disclosed in order to do a better cleaning job with less effort.

The extended section 60 defines a fluid delivery system and is interconnected the pump section 30 by a press fit connector 62. This press fit connector 62 is designed in this particular embodiment to resist separation once combined. The reason for this is a tongue and groove engagement which is present between these parts at this location. Other connectors could be utilized.

The extended stem section 60 itself is a longitudinally extending pipe section having a hollow center suitable for passing the aqueous fluid therethrough. In the preferred embodiment, an enlarged diameter section 61 of the interconnection to the pump 30 allows for the angular and radial forces therebetween to be spread out over a surface significantly greater in diameter than the connector 62 itself. This further strengthens the interconnection against any forces which may be placed thereon.

At the other end of the extending stem section 60, a further connector 65 retains the brush section 70 onto the extending stem section 60. Again a tongue and groove interlock is utilzed, and again other connectors could be used. Again, in the preferred embodiment disclosed, the groove interlocking mechanism in the connector insures that the brush section 70 is resistant to any separation at this particular location. The particular extended section is 4.5 inches long and 4 inches in overall diameter.

It is preferred that these connectors 62, 65 be relative duplicates of each other so as to allow for the brush section and/or any other auxiliary part to be interconnected directly to the pump section should the manufacturer and/or operator deem it necessary and appropriate. This would, for example, allow a greater force to be applied to the example brush.

The brush section is the main operative member for the cleaning system. The brush section 70 can include any of a number of differing cleaning implements including a sponge, horse shoe bristle brush, a scrubber, a squeegee, a paint brush, or any other of a myriad of auxiliary cleaning and other devices suitable for use with an aqueous solution from a bottle.

It is preferred that these alternate embodiments be directly replaceable with the brush however connected to the bottle.

The brush section 70 disclosed is unique design having two stages of bristles, stiffer upper bristles 72 and longer, softer, lower bristles 73. The stiffer bristles 72 are designed for heavy duty cleaning, particularly under such hard to reach areas as under the brim of commodes, while the longer bristles are designed to remove surface soil and for everyday cleaning.

To assist in this cleaning, the cleaning system utilizes the aqueous solution which is contained within the bottle 10. However, the particular brush section 70 disclosed has a solid nylon brush plug 75 in the center thereof, with the bristles being interconnected thereto through a series of holes 76 and staples 77 extending into the center of the brush plug from the bottom of the holes. This particular construction creates a series of intersecting wire staples 77 down the center of the brush plug 75, which staples are necessary to interconnect the bristles 72, 73 to the plug 75. In order to avoid the inconvenience of a brush section 70 that has to have the aqueous fluid dispensed down the center thereof, it was found that by using holes 80 extending radially off of the hollow connecting head portion 78 of the brush plug, it is possible for the aqueous solution to be dispensed thoroughly over the entire confines of the brush. This avoids the otherwise necessary additional expense in engineering and in overall construction of the brush. This allows the brush 70 to be smaller, tougher, and longer lasting than if an alternate construction was used. This is preferred.

Any alternative attachments used to replace the brush 70 would incorporate suitable mounting openings in order to disperse the aqueous solution in respect to such other attachments. This could, in certain applications (including brushes like 70) include longitudinal passages therein.

The cleaning system is preferably used with a caddy stand section 90. This caddy stand 90 is designed with a support 91 and a base 95.

The dimensions and shape of the support 91 is designed to match that of the particular attachment being utilized with the cleaning system. For example, in the preferred embodiment disclosed, the brush 70 has a substantially semi circular lower surface. For this reason, the support 91 is designed to have a surface matching this so as to solidly support the cleaning system.

In this respect, please note that since the support 91 is inserted into the base, it is possible to utilize a single base with many differing supports and visa versa.

The base 95 is designed to retain the cleaning system as an entire entity on a flat surface. Further, the back 96 of the base serves to interconnect a hanging frame 100 to the base. This allows the caddy stand section 90 to be hung by the hanging frame above the ground. A caddy clip 104 selectively interconnects the pump section with the hanging frame, thus to integrate the remainder of the cleaning system with such stand.

An opening 97 in the top of the base allows the attachment (such as the brush section) to be longitudinally inserted into the caddy stand section 90 with the clipping to the caddy clip 104 completing the storage positioning of such cleaning system.

Although the invention has been described in its preferred embodiment with a certain degree of particularity, it is to be understood that numerous changes can be made without deviating from the invention as hereinafter claimed. For example differing pumps could be used such as lever pumps, push button pumps, pressurization of bottle pumps, etc. Similarly other valves could be utilized, as could differing locks and caddies.

What is claimed is:

1. In a cleaning system having a bottle of an aqueous solution, the bottle having a neck with threads and a diameter, the cleaning system comprising the neck of the bottle having a length, a connection section having two ends, one end of said connection section having a tubular section with threads and a length, said length of said tubular section being equal to or greater than the length and diameter of the neck section of the bottle, the neck of the bottle being in said tubular section in contact therewith for substantially the full length of the neck, the threads of the neck of the bottle engaging said threads of said tubular section, a brush section, means to connect said brush section to the other end of said connection section, the threads of the bottle having a length and further comprising the length of the neck of the bottle being greater than the length of the threads of the bottle.

2. The cleaning system of claim 1 characterized that the neck of the bottle is at least partially not threaded, and said at least partially not threaded section being within said tubular section of said connection section.

3. The cleaning system of claim 1 characterized in that said means to connect said brush section to the other end of said connection section includes a valve.

4. The cleaning system of claim 3 characterized in that said means to connect said brush section to the other end of said connection section includes a selectively operable pump.

5. In a cleaning system having a bottle of an aqueous solution, the bottle having a neck with threads and a diameter, the cleaning system comprising the neck of the bottle having a length, a connection section having two ends, one end of said connection section having a tubular section with threads and a length, said length of said tubular section being equal to or greater than the length and diameter of the neck section of the bottle, the neck of the bottle being in said tubular section in contact therewith for substantially the full length of the neck, the threads of the neck of the bottle engaging said threads of said tubular section, a brush section, means to connect said brush section to the other end of said connection section, said means to connect said brush section to the other end of said connection section including a valve, and a selectively operable pump and said pump being a piston pump.

6. The cleaning system of claim 1 characterized in that said means to connect said brush section to the other end of said connection section includes an extended section, and said extended section being longer than twice said diameter of the neck of the bottle.

7. The cleaning system of claim 1 characterized by the addition of a handle for the bottle.

8. In a cleaning system having a bottle of an aqueous solution, the bottle having a neck with threads and a diameter, the cleaning system comprising the neck of the bottle having a length, a connection section having two ends, one end of said connection section having a tubular section with threads and a length, said length of said tubular section being equal to or greater than the length and diameter of the neck section of the bottle, the neck of the bottle being in said tubular section in contact therewith for substantially the full length of the neck, the threads of the neck of the bottle engaging said threads of said tubular section, a brush section, means to connect said brush section to the other end of said connection section, said bottle having a handle, said bottle having a primary reservoir, said handle being a handgrip separate from said primary reservoir, and said handle being hollow.

9. In a cleaning system having a bottle of an aqueous solution, the bottle having a neck with threads and a diameter, the cleaning system comprising the neck of the bottle having a length, a connection section having two ends, one end of said connection section having a tubular section with threads and a length, said length of said tubular section being equal to or greater than the length and diameter of the neck section of the bottle, the neck of the bottle being in said tubular section in contact therewith for substantially the full length of the neck, the threads of the neck of the bottle engaging said threads of said tubular section, a brush section, means to connect said brush section to the other end of said connection section, said bottle having a handle, said handle being an integral handle, said integral handle being hollow, and said hollow connected to said primary reservoir to form a secondary reservoir.

10. A cleaning system for an aqueous solution comprising a bottle, said bottle having a neck and a handle, a pump, said pump being separate from said bottle, connection section means to connect said neck of said bottle to said pump, a relief valve, and means to associate said relief valve with said bottle, a brush section, means to connect said brush section to said pump, means to selectively operate said pump to place the aqueous solution on said brush section, and means for said handle of said bottle to selectively manipulate said brush section.

11. The cleaning system of claim 10 characterized in that said neck of said bottle has an extended length and a diameter, said connection section means has a tubular section with a length with said extended neck of said bottle being in said tubular section of said connection means, and said length of said extended neck being substantially equal to said length of said tubular section and greater than the diameter of said neck.

12. The cleaning system of claim 11 characterized in that said extended neck of said bottle has an outer end with screw threads, said tubular section of said connection section has an inner end with screw threads, and a length, said screw threads of said tubular section extending less than said length of said tubular section, and said screw threads of said extended neck of said bottle engaging said screw threads of said tubular section to join said bottle to said pump.

13. The cleaning system of claim 12 characterized by the addition of a gap and said gap being located adjacent said screw threads of said extended neck of said bottle.

14. A cleaning system for an aqueous solution comprising a bottle, said bottle having a neck and a handle, a pump, said pump being separate from said bottle, connection section means to connect said neck of said bottle to said pump, a relief valve, and means to connect said relief valve to said bottle, a brush section, means to connect said brush section to said pump means to selectively operate said pump to place the aqueous solution on said brush section, means for said handle of said bottle to selectively manipulate said brush section, holes in said means to connect said brush section to said pump outside of said brush section, and means to pass aqueous solution from said pump through said holes.

15. The cleaning system of claim 14 characterized by means to connect bristles to said brush section, said means including a brush plug, and said holes not being located in said brush plug.

16. A cleaning system for an aqueous solution comprising a bottle, said bottle having a neck and a handle, a pump, said pump being separate from said bottle, connection section means to connect said neck of said bottle to said pump, a relief valve, and means to associate said relief valve with said bottle, a brush section, means to connect said brush section to said pump, means to selectively operate said pump to place the aqueous solution on said brush section, means for said handle of said bottle to selectively manipulate said brush section, said pump including a piston section, and means to push said bottle towards said brush section to operate said piston section.

17. A cleaning system for an aqueous solution comprising a bottle, said bottle having a neck and a handle, a pump, said pump being separate from said bottle, connection section means to connect said neck of said bottle to said pump, a relief valve, and means to connect said relief valve to said bottle, a brush section, means to connect said brush section to said pump, means to selectively operate said pump to place the aqueous solution on said brush section, means for said handle of said bottle to selectively manipulate said brush section, said bottle having a primary reservoir and said handle being a handgrip separate from said primary reservoir.

18. The cleaning system of claim 17 characterized in that said handle being hollow and means to connect said hollow of said handle to said primary reservoir to form a secondary reservoir.

19. A cleaning system for an aqueous solution comprising a bottle, said bottle having a neck and a handle, a pump, said pump being separate from said bottle, connection section means to connect said neck of said bottle to said pump, a relief valve, and means to connect said relief valve to said bottle, a brush section, means to connect said brush section to said pump, means to selectively operate said pump to place the aqueous solution on said brush section, means for said handle of said bottle to selectively manipulate said brush section, and said pump being a piston pump.

20. A cleaning system for an aqueous solution comprising a bottle, said bottle having a neck and a handle, a pump, said pump being separate from said bottle, connection section means to connect said neck of said bottle to said pump, a relief valve, and means to connect said relief valve to said bottle, a brush section, means to connect said brush section to said pump, means to selectively operate said pump to place the aqueous solution on said brush section, means for said handle of said bottle to selectively manipulate said brush section, the means to selectively operate said pump including moving one of said bottle and/or said brush section towards the other.

21. A cleaning system for an aqueous solution comprising a bottle, said bottle having a neck with a diameter and a handle, said neck of said bottle has an extended length, a pump, said pump being separate from said bottle, a connection section means to connect said neck of said bottle to said pump, a relief valve, means in said connection section to associate said relief valve with said bottle, said connection section means having a tubular section with a length, said tubular section having inner and outer ends, said extended length of said neck being substantially equal to said length of said tubular section and greater than said diameter of said bottle, said neck of said bottle being in said tubular section of said connection section means in contact with said inner and outer ends of said tubular section, a brush section, means to connect said brush section to said pump, and means to selectively operate said pump to place the aqueous solution on said brush section.

22. The cleaning system of claim 21 characterized in that said neck of said bottle has an outer end with screw threads, said tubular section of said connection section means has an inner end with screw threads, and a length, said screw threads extending for less than said length of said tubular section, and said screw threads of said neck of said bottle engaging said screw threads of said tubular section to join said bottle to said pump.

23. A cleaning system for an aqueous solution comprising a bottle, said bottle having a neck with a diameter and a handle, said neck of said bottle has an extended length, a pump, said pump being separate from said bottle, a connection section means to connect said neck of said bottle to said pump, a relief valve, means in said connection section to connect said relief valve to said bottle, said connection section means having a tubular section with a length, said tubular section having inner and outer ends, said extended length of said neck being substantially equal to said length of said tubular section and greater than said diameter of said bottle, said neck of said bottle being in said tubular section of said connection section means in contact with said inner and outer ends of said tubular section, a brush section, means to connect said brush section to said pump, means to selectively operate said pump to place the aqueous solution on said brush section, said neck of said bottle having an outer end with screw threads, said tubular section of said connection section means having an inner end with screw threads, and a length, said screw threads extending for less than said length of said tubular section, said screw threads of said neck of said bottle engaging said screw threads of said tubular section to join said bottle to said pump, a gap and said gap being located adjacent said screw threads of said extended neck of said bottle.

24. A cleaning system for an aqueous solution comprising a bottle, said bottle having a neck with a diameter and a handle, said neck of said bottle has an extended length, a pump, said pump being separate from said bottle, a connection section means to connect said neck of said bottle to said pump, a relief valve, means in said connection section to connect said relief valve to said bottle, said connection section means having a tubular section with a length, said tubular section having inner and outer ends, said extended length of said neck being substantially equal to said length of said tubular section and greater than said diameter of said bottle, said neck of said bottle being in said tubular section of said connection section means in contact with said inner and outer ends of said tubular section, a brush section, means to connect said brush section to said pump, means to selectively operate said pump to place the aqueous solution on said brush section, said neck of said bottle having an outer end with screw threads, said tubular section of said connection section means having an inner end with screw threads, and a length, said screw threads extending for less than said length of said tubular section, said screw threads of said neck of said bottle engaging said screw threads of said tubular section to join said bottle to said pump, holes in said means to connect said brush section to said pump and means to pass aqueous solution from said pump through said holes.

25. The cleaning system of claim 24 characterized by means to connect bristles to said brush section, said means including a brush plug, and said holes not being located in said brush plug.

26. A cleaning system for an aqueous solution comprising a bottle, said bottle having a neck with a diameter and a handle, said neck of said bottle has an extended length, a pump, said pump being separate from said bottle, a connection section means to connect said neck of said bottle to said pump, a relief valve, means in said connection section to connect said relief valve to said bottle, said connection section means having a tubular section with a length, said tubular section having inner and outer ends, said extended length of said neck being substantially equal to said length of said tubular section and greater than said diameter of said bottle, said neck of said bottle being in said tubular section of said connection section means in contact with said inner and outer ends of said tubular section, a brush section, means to connect said brush section to said pump, means to selectively operate said pump to place the aqueous solution on said brush section, said neck of said bottle having an outer end with screw threads, said tubular section of said connection section means having an inner end with screw threads, and a length, said screw threads extending for less than said length of said tubular section, said screw threads of said neck of said bottle engaging said screw threads of said tubular section to join said bottle to said pump, said pump including a piston section and means to push said bottle towards said brush section to operate said piston section.

27. A cleaning system for an aqueous solution comprising a bottle, said bottle having a neck and a handle, a brush section, said neck of said bottle having a diameter and an extended length to an outer end, said neck having threads on said outer end thereof, a pump, said pump being separate from said bottle, connection section means to connect said neck of said bottle to said pump, said connection section means having a tubular section with a length, said length of said tubular section being greater than said diameter of said neck of said bottle, said tubular section having inner and outer ends, said inner end of said tubular section having threads being less than said length of said tubular section, said extended length of said neck being substantially equal to said length of said tubular section, said neck of said bottle being in said tubular section of said connection section means and in contact with said inner and outer ends of said tubular section, said threads of said outer end of said neck engaging said threads of said inner end of said tubular section to join said bottle to said pump, a gap, said gap being located adjacent said screw threads of said extended neck of said bottle, said pump including a piston section between said tubular section and the remainder of said connection section means, means to selectively lock said tubular section in position in respect to the remainder of said connection section means, means to push said bottle towards said brush section to operate said piston section, a relief valve, means to associate said relief valve with the outer end of said neck of said bottle, means to connect said brush section to said pump, and said operation of said piston section of said pump placing the aqueous solution on said brush section.

28. The cleaning system of claim 27 characterized by the addition of a stem section, an aqueous fluid delivery system down said stem section, said stem section being attached to said connection section means, said brush section including a brush plug with a head portion, means to connect said head portion of said brush plug to said stem section, cleaning implements, means to connect said cleaning implements to said brush plug, holes, said holes being in said head portion of said brush plug spaced from said cleaning implements, and means to fluidly connect said holes of said head portion to the fluid delivery system down said stem section and thus aqueous fluid flows to said brush.

29. The cleaning system of claim 27 characterized in that said means to selectively lock said tubular section in position includes a rotary lock.

30. The cleaning system of claim 27 characterized in that the neck of the bottle is at least partially not threaded.

31. The cleaning system of claim 27 characterized in that said means to connect said brush section to the other end of said connection section includes an extended section.

32. The cleaning system of claim 7 characterized in that said bottle has a primary reservoir said handle is a hollow handgrip separate from said primary reservoir, and means to connect said hollow handgrip to said bottle from a secondary reservoir.

33. A cleaning system for an aqueous solution comprising a bottle, said bottle having a neck and a handle, a brush section, said neck of said bottle having an extended length to an outer end, said neck having threads on said outer end thereof, the outer diameter of said neck of said bottle including said threads being substantially uniform for substantially the full length of said threads, a connection section, said connection section having two ends, one end of said connection section being a tubular section, said tubular section having an inner and outer end and a length, said inner end of said tubular section having threads, said extended length of said neck being substantially equal to said length of said tubular section and greater than said outer diameter of said neck of said bottle, the inner diameter of said tubular section being substantially equal to said outer diameter of said neck of said bottle, said neck of said bottle being in said tubular section in contact with said inner and outer ends of said tubular section with said outer diameter of said neck in contact with said inner diameter of said tubular section for substantially said extended length of said neck, a pump, said threads of said outer end of said neck engaging said threads of said inner end of said tubular section to join said bottle to said pump, a gap, said gap being located adjacent said threads of said extended neck of said bottle, said pump having a body with two ends, means to movingly connect one end of said body of said pump to said other end of said connection section to create a piston for aqueous solutions means to operate said pump, a one way valve, said one way valve being in said other end of said connection section, a second one way valve, said second one way valve being in the other end of said body of said pump, a relief valve, means to associate said relief valve with said bottle between said one way valve and said outer end of said bottle, means to selectively lock said connection section in position in respect to said body of said pump, means to push said bottle towards said brush section to operate said piston, and means to connect said brush section to said other end of said pump.

34. The cleaning system of claim 33 characterized by the addition of a stem section, an aqueous fluid delivery system down said stem section, said stem section being attached to said other end of said pump, said brush section including a solid brush plug with a hollow head portion, means to connect said hollow head portion of said brush plug to said stem section, cleaning implements, means to connect said cleaning implements to said solid brush plug, holes, said holes being in said hollow head portion of said brush plug spaced from said cleaning implements, and means to fluidly connect said holes of said hollow head portion to the fluid delivery system down said stem section and thus aqueous fluid flows to said brush section.

* * * * *